United States Patent [19]

Springer et al.

[11] 4,263,500

[45] Apr. 21, 1981

[54] INFRARED HEATING HAIR DRYER

[75] Inventors: William E. Springer, Bridgeport; Henry J. Walter, Wilton, both of Conn.

[73] Assignee: Clairol Incorporated, New York, N.Y.

[21] Appl. No.: 36,940

[22] Filed: May 7, 1979

Related U.S. Application Data

[63] Continuation-in-part of Ser. No. 916,995, Jun. 19, 1978, abandoned.

[51] Int. Cl.[3] ..... H05B 3/00

[52] U.S. Cl. ..... 219/377; 219/343; 34/4

[58] Field of Search ..... 219/343, 347, 348, 354, 219/353, 377, 270, 367-371, 373-376, 379-381; 34/96-100; 132/7, 9, 11 R; 250/493-495; 128/395-399; 34/4

[56] References Cited

U.S. PATENT DOCUMENTS

| | | | |
|---|---|---|---|
| 1,605,421 | 11/1926 | Anderson | 219/354 |
| 1,660,802 | 2/1928 | Martin | 219/377 |
| 1,713,013 | 5/1929 | Wandless | 219/347 |
| 2,026,991 | 1/1936 | Martin | 219/377 |
| 2,658,984 | 11/1953 | Mohn | 219/354 |
| 3,045,100 | 7/1962 | Mills | 219/354 |
| 3,289,679 | 12/1966 | Zellerman | 219/347 |
| 3,602,693 | 8/1971 | Grounner | 219/354 |
| 3,636,306 | 1/1972 | Bumpus | 219/343 |
| 3,692,977 | 9/1972 | Duhamel et al. | 219/343 |
| 3,792,230 | 2/1974 | Ray | 219/343 |
| 3,864,547 | 2/1975 | Ray | 219/377 |
| 3,867,948 | 2/1975 | Kallenborn | 219/354 |

FOREIGN PATENT DOCUMENTS

| | | | |
|---|---|---|---|
| 1139096 | 6/1957 | France | 219/343 |
| 197808 | 8/1978 | United Kingdom | 34/97 |

OTHER PUBLICATIONS

Euras Brochure on I.R. Hair Dryer, 3/19/80.

"Radiant Heat and Comfort", Hartly, Harold, The Institute of Fuel, F.R.B. Technical Paper, No. 12, pp. 358-364, Aug. 1934.

Curl-n-Lite Brochure, Mahdeen Laboratories, 1976.

Super Lamp Brochure, Conair Corporation, 1975.

*Primary Examiner*—Thomas J. Kozma

*Assistant Examiner*—Bernard Roskoski

*Attorney, Agent, or Firm*—Gerald S. Rosen; George A. Mentis

[57] ABSTRACT

A hair dryer is provided which dries hair by directing thereagainst radiant infrared heat energy. The dryer includes an infrared (IR) energy source, such as a silicone carbide igniter, an anodized parabolic reflector for modifying the wavelength of IR radiation reflected by selective IR reflection, and a transparent IR filter lens on the outlet of the dryer to absorb unwanted wavelengths and a fan for developing a low velocity air stream which both cools the IR heat source and breaks up vapor layers on the hair. The wavelength of the IR radiation which is emitted is preferably from above about 0.8 microns to about 10 microns, which includes the maximum IR absorption spectrum of wet hair, i.e., about 2 to 3 and about 6 to 8 microns.

6 Claims, 3 Drawing Figures

INFRARED HEATING HAIR DRYER

RELATED APPLICATIONS

This application is a continuation-in-part of U.S. Pat. application Ser. No. 916,995 filed June 19, 1978, now abandoned.

BACKGROUND OF THE INVENTION

This invention relates to a hair dryer. More specifically it relates to a hair dryer which utilizes a selective range of wavelengths of infrared (IR) radiation of drying hair and a low velocity air stream that breaks up water vapor layers on the hair.

Prior art hair dryers utilizing IR heaters have been found to be cumbersome because of their use of large, conventional IR lamps. Also such known hair dryers have been found to produce excessive temperatures in the hair under normal conditions of hair drying. For instance, when placed at a distance of one inch from the hair, such a known dryer produces a temperature therein of 230 degrees C. These hair dryers do not use a selective range of wavelengths of IR radiation to dry the hair. The hair dryer of the present invention at that same distance from the hair produces a temperature therein of about 90 degrees C., which is more than sufficient for hair drying because of the structure of this dryer discussed below.

SUMMARY OF THE INVENTION

A hair dryer is provided which includes a fan for blowing an air stream at low velocity out of the dryer, an IR energy source for emitting infrared radiation from the dryer, an anodized parabolic reflector which modifies the radiated energy by only reflecting selected wavelengths, and a transparent IR filter to further narrow the emitted IR radiation to the desired wavelength range. Preferably the IR energy source is a silicone carbide "Globar" igniter and the anodized parabolic reflector is black.

In accordance with this invention, we have discovered that in order to dry wet hair most efficiently with an IR hair dryer, the IR wavelengths to be emitted from the dryer should be in the wavelength range approximating the maximum absorption spectrum of wet hair. These wavelength regions encompass the strongest fundamental infrared absorption bands of molecular water and hair. The infrared wavelengths which fit this criteria are those above about 0.8 microns. Wavelengths of greater than about 10 microns, e.g., those up to 25 microns, will be absorbed by wet hair and dry the hair, however, as the wavelengths increase, the drying becomes more inefficient. Therefore, we have found that IR radiation of wavelengths of from about 0.8 to about 10 microns is preferred. We have found that the maximum IR absorption spectum of wet hair is in the wavelength bands of about 2 to 3 and 6 to 8 microns and the most efficient drying occurs when these wavelengths are simultaneously emitted from the dryer. Dry hair absorbs IR radiation very poorly and absorbs visible radiation much better. Thus, an advantage of this invention is that as the hair is dried, the dry hair shields the scalp since it does not absorb the selected IR wavelengths. In addition, the user can tell when the drying operation is complete because the hair feels cooler.

Accordingly, IR energy emitted at the above discussed wavelengths will be satisfactory for use in this invention and will dry hair at no more than about the 90 degrees C. mentioned above. The energy source emits both visible and IR wavelengths. In order to restrict this radiation to the maximum absorption spectrum of wet hair, an aluminum anodized parabolic reflector in combination with a transparent IR filter is used. The reflector absorbs the visible radiation and some of the IR radiation and the filter is selected to allow emission only of the desired IR wavelengths. In order to assist in accomplishing the drying in as short a time as possible at low temperatures, it is preferred to introduce a low velocity air stream to carry away the water vapors from the surface of the hair without chilling or condensation.

DETAILED DESCRIPTION OF THE INVENTION

Figure 1:
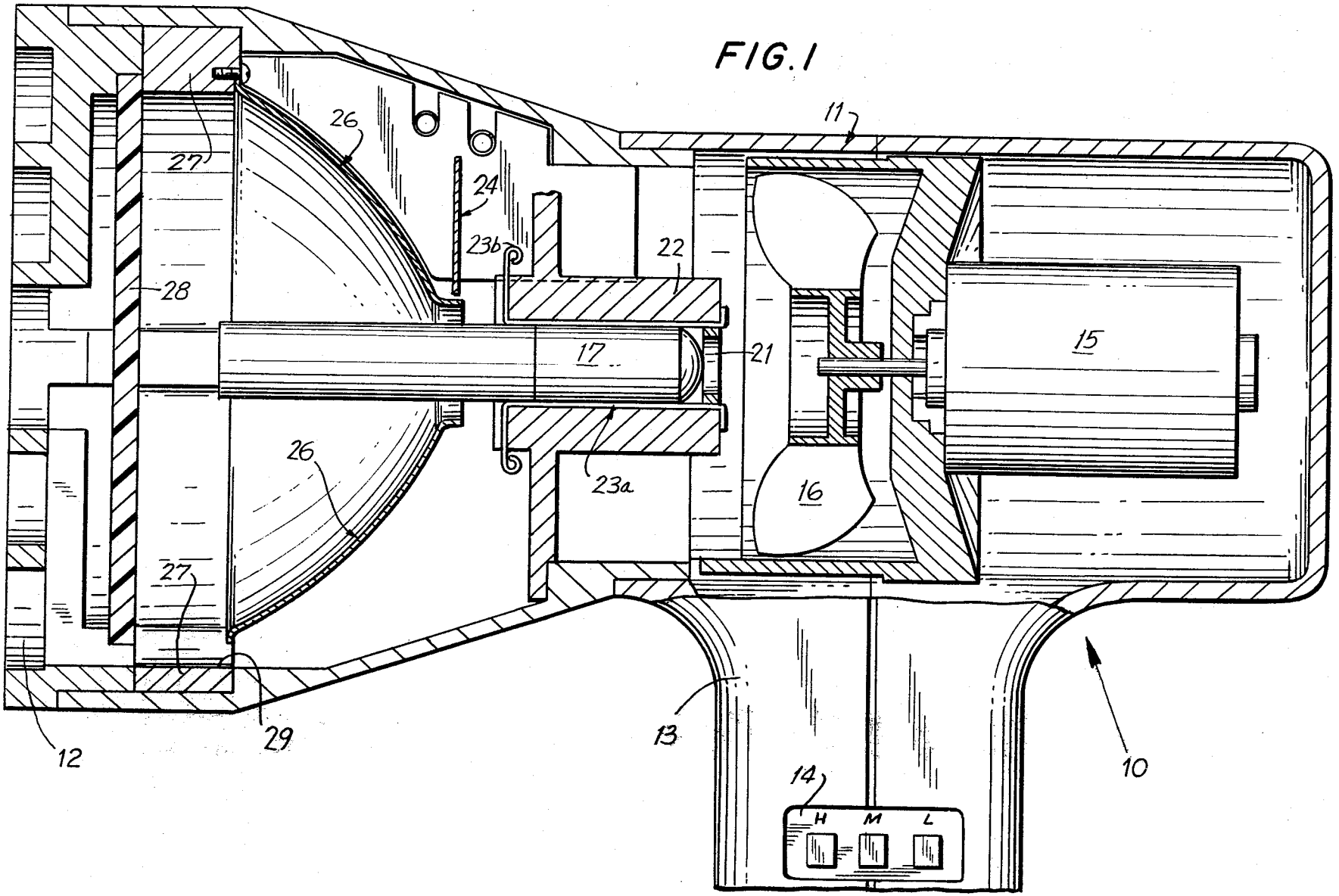
FIG. 1 is a partially broken-away, side view of a dryer of this invention.

Referring to FIG. 1, the dryer indicated generally at 10 includes a housing 11, outlet grill 12, a handle 13, and a switch 14 in handle 13. Inside the dryer 10 is a fan motor 15, which operates a fan 16 that blows a low velocity air stream out of the dryer around the outer rim of the grill 12.

Disposed between the fan and grill is an IR energy source for emitting IR radiant heat which acts to dry hair. In addition, the air stream picks up heat by cooling the IR energy source and maintaining it at operational temperatures. This air stream assists in the efficiency of the hair drying operation since it carries away water vapors from the surface of the hair, preventing buildup of layers of water vapor on the hair which shield the hair from radiant heat. The low velocity prevents the air from cooling the water vapor and causing condensation. The energy source depicted is a silicone carbide "Globar" igniter 17. As shown best in FIG. 2, the igniter 17 includes an alumina fin 18, which terminates on one end of an alumina body member 19 shown in dotted line, which body member is coated with a recrystallized silicone carbide coating 20. This electrical resistor type heater is capable of heating up to about 1800 degrees F. in less than 80 seconds. It is available from the Carborundum Company of Niagara Falls, New York under the designation Type CD1; Model 0206D; Voltage 80±1 Vac; Current 2.0–3.6 amperes. Timing 1800° F.<60 seconds.

Each end of the fin 18 is supported in a slot of a block 21 to prevent movement of the igniter. Surrounding and supporting the coated body member of the igniter is a member 22, which has affixed on its inner surface two electrical contacts 23*a* and 23*b*. The contacts are conventionally connected to a switch 14 and ultimately to a power source for electrically energizing the igniter.

Figures 2, 3:
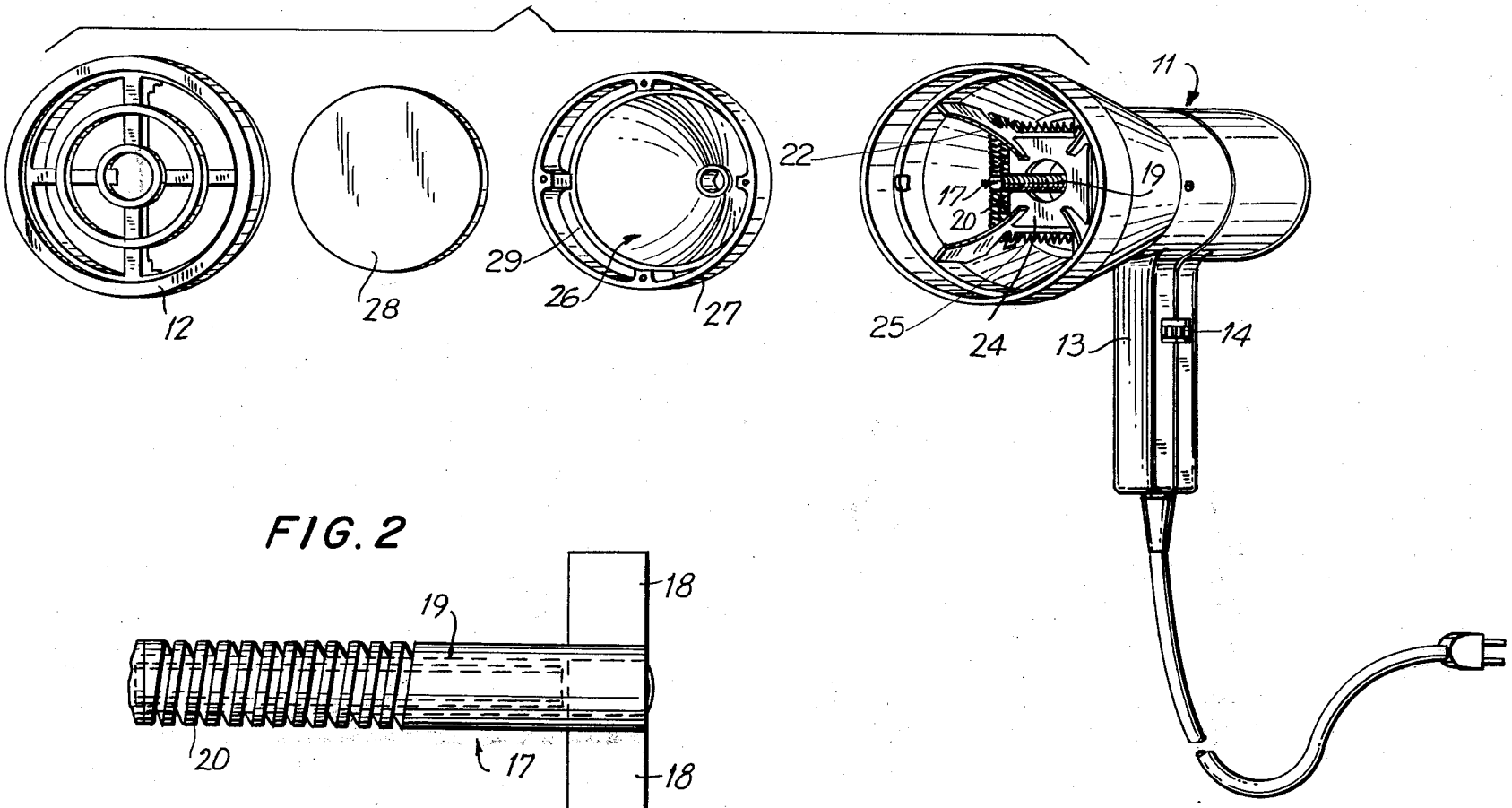
FIG. 2 is a schematic view of a silicone carbide igniter useful in the dryer of FIG. 1.
FIG. 3 is a view showing the various components of the dryer of FIG. 1 in its disassembled condition.

As best shown in FIG. 3, forward of and surrounding the coated body portion of the igniter 17 is a heater board support 24 around which is an open coil resistor 25 that is used to reduce the voltage of the motor 15 for operation in the dryer 10 of this invention. The support 24 also holds in place in the dryer 10 an anodized parabolic reflector 2. This parabolic reflector 26 preferably is made of aluminum and has on its reflecting surface a darkly pigmented, anodized coating to maximize IR radiation of the desired wavelength and minimize radiation of the visible spectrum.

Maintaining the reflector 26 in place in the dryer is a reflector support 27, which also provides a surface against which an IR filter lens 28 abuts.

The filter lens 28 preferably filters out most of the IR radiation coming from the dryer except IR wavelengths of greater than about 0.8 microns and is made of a borosilicate, furnace observation glass available from the Corning Glass Work Company, Corning, New York under the name "Code 7740". The filter lens can be chosen to allow only IR wavelengths of about 0.8 to about 10 microns or IR wavelengths of about 2 to 3 and about 6 to 8 microns to be emitted. Holding the lens 28 in place is a grill 12.

In operation of the dryer, air is drawn into it through an appropriate inlet in the rear of the housing 11 by fan 16. The air is blown at low velocity over the rear surface of the reflector 26 and around the opening, indicated at 29, between the reflector 26 and the surrounding support and housing structures described above. As the igniter 17 heats up, it emits IR radiation. The air stream picks up heat from the igniter 17 and the resistor 25 as it flows through the dryer 10. The wavelength of IR radiation from the igniter 17 which is reflected by the parabolic reflector 26 is essentially in the range of about 0.8 microns and above, essentially all the remaining visible and IR radiation is absorbed. Thus, the air stream also picks up heat from the reflector 26. As the reflected IR radiation is emitted from the dryer 10, the wavelength is further narrowed to remove less preferred radiation by the filter lens 28. This results in an IR emission of a wavelength spectrum of greater than about 0.8 microns or from about 0.8 microns to about 10 microns or from about 2 to 3 and about 6 and 8 microns, depending on the particular filter used.

The IR radiation, which encompasses the maximum absorption spectrum for wet hair heats only the hair and water thereon causing the water to vaporize. The slow velocity air stream which is warm, blows away the water vapor, preventing it from building up layers and shielding the hair from further radiation. Because the air is warm and is moving at a slow velocity, it does not cool the hair or cause the water vapor to condense. As the hair is dried, it shields the scalp from the IR radiation and heat.

Thus, the IR radiation of the selected wavelengths and the air stream coact to dry hair efficiently and relatively quickly at low temperatures when the dryer 10 of this invention is used.

It is contemplated that if only IR radiation drying is desired, the opening 29 can be redefined to vent substantially all the air stream from the dryer 10 without blowing it out through the grill 12. Also, it is contemplated that the IR energy source utilized can be one other than the igniter 17 described above, as long as it is capable of emitting IR radiation of the proper wavelength and is of a size adaptable to the hair dryer of this invention.

What is claimed is:

1. An infrared radiation hair dryer comprising a housing with an air inlet and an air outlet, said housing containing therein a motor that operates a fan which blows air from the dryer at low velocity, an infrared energy source between the fan and the air outlet and which directs essentially all its's emissions to a reflector between the infrared energy source and the air outlet which reflects substantially only infrared radiation of a wavelength spectrum of greater than about 0.8 microns out of the dryer while minimizing the reflection of a wavelength spectrum less than about 0.8 microns, and a transparent infrared filter between the reflector and the air outlet that allows only infrared radiation of from greater than about 0.8 microns to about 10 microns to be emitted from the dryer.

2. The hair dryer of claim 1 wherein the infrared energy source is a silicone carbide igniter.

3. The hair dryer of claim 1 wherein the reflector is anodized with a darkly pigmented coating for absorbing substantially all visible radiation and reflecting the infrared spectrum which is maximally absorbed by wet hair.

4. The hair dryer of claim 1 wherein the infrared energy emitted through said filter is of the wavelength of from above about 0.8 microns to about 10 microns.

5. The hair dryer of claim 1 wherein the infrared energy emitted through said filter is simultaneously essentially only of the wavelength bands of about 2 to 3 and about 6 to 8 microns.

6. An infrared radiation hair dryer comprising a housing with an air inlet and an air outlet, said housing containing therein a motor that operates a fan which blows air from the dryer at low velocity, an infrared energy source between the fan and the air outlet and which directs essentially all it's emissions to a reflector between the infrared energy source and the air outlet which reflects substantially only infrared radiation of a wavelength spectrum of greater than about 0.8 microns out of the dryer while minimizing the reflection of a wavelength spectrum less than about 0.8 microns, and a transparent infrared filter lens between the reflector and the air outlet that allows only infrared radiation of from greater than about 0.8 microns to about 10 microns to be emitted from the dryer, wherein said air blown from the dryer is warm, exits at low velocity and absorbs water vapor layers from the surface of the hair being dried, preventing buildup of said layers.

* * * * *